US005246288A

United States Patent [19]

Jetzer et al.

[11] Patent Number: 5,246,288

[45] Date of Patent: Sep. 21, 1993

[54] MIXER, AND METHOD FOR ADMIXING SOLID PARTICULATE

[76] Inventors: James R. Jetzer, 909 Lee Ave., Howards Grove, Wis. 53081; Wayne E. Schlosser, 913 Frost Rd., Howards Grove, Wis. 53083; Dale E. Soerens, N2155 Frontage Rd., Oostburg, Wis. 53070

[21] Appl. No.: 963,763

[22] Filed: Oct. 29, 1992

[51] Int. Cl.[5] ..... B01F 15/00; B01F 7/04

[52] U.S. Cl. ..... 366/143; 366/279

[58] Field of Search ..... 366/279, 308, 309, 310, 366/311, 312, 313, 320, 325, 326, 327, 328, 329, 330, 241, 64, 143

[56] References Cited

U.S. PATENT DOCUMENTS

| | | | |
|---|---|---|---|
| 1,607,345 | 11/1926 | Harding | 366/312 |
| 3,940,116 | 2/1976 | Verlinden | 366/279 |
| 4,854,717 | 8/1989 | Crane | 366/309 |

FOREIGN PATENT DOCUMENTS 1046967 7/1953 France .

*Primary Examiner*—Robert W. Jenkins

*Attorney, Agent, or Firm*—R. Jonathan Peters

[57] ABSTRACT

The present invention provides a mixer, especially adaptable for admixing solid plastic particulate, and with one or more additives, comprising a substantially horizontally disposed cylinder, slightly inclined with respect to the horizontal plane, and an inlet and outlet disposed above and below, respectively, the horizontal plane. A plurality of impellers depend radially from a horizontally disposed driven shaft, each impeller terminating outwardly with an enlarged planar surface obliquely angled relative to the radial plane and in the direction of rotation. A portion of the radial edge from the angle outwardly is tapered inwardly relative to the radial axis.

24 Claims, 4 Drawing Sheets

MIXER, AND METHOD FOR ADMIXING SOLID PARTICULATE

FIELD OF THE INVENTION

This invention relates to a mixer, especially adaptable for admixing solid particulate, and to the method of admixing solid particulate on a continuous basis. In its more specific aspect, this invention relates to a mixer, especially adaptable for admixing plastic as solid particulate, including virgin and recycled plastic particulate, which further may be admixed with solid or liquid additives, and to the method of admixing such materials on a continuous basis.

BACKGROUND AND PRIOR ART

Mixers or blenders are used by a variety of industries in order to obtain a substantially uniform admixture that can be processed or fabricated into a final product. If the admixture is not uniform, the final product typically will exhibit or on testing show imperfections or disparities in composition, appearance, or properties. Hence, the mixing operation, sometimes regarded as premixing because mixing precedes the fabrication step, is critical to obtaining a substantially uniform product. Good and effective mixing is particularly difficult in admixing solid particulate, especially solid particulate of varying or different composition, grade, or type. Thus, in the plastics industry, the solid pellets or beads are fed by conventional means as from a hopper to the extruder screw, typically along with one or more additives, which heats and admixes the material as it screw fed to the extruder head. The plastic feed material frequently gets overheated, and/or there is poor admixing of the materials, thereby resulting in an inferior product exhibiting striations, mottling, and the like. For these reasons, mixers, or premixers, for use upstream of the extruder screw, whether for a continuous or batch process, are not customarily in use by the plastic industry.

This invention has therefore as its purpose to provide a mixer for admixing solid particulate, especially plastic particulate of different grades, composition, and type, and with or without other additives, which overcomes the disadvantages of the prior art.

SUMMARY OF THE INVENTION

The mixer of the present invention, which is particularly adaptable for admixing solid particulate, comprises a generally horizontally disposed cylinder having a cylindrical side wall and end closure means, thereby defining a chamber. It should be understood that such terms as "generally horizontal" or "substantially horizontal" as used herein and in the appended claims with reference to the cylinder are intended to include a cylinder having its central longitudinal axis inclined with respect to the true horizontal plane, and in the preferred embodiment, this incline is from about 5 to 20 degrees from the true horizontal. The cylinder wall is provided with an inlet and outlet positioned above and below, respectively, the central horizontal axis of the cylinder, and with respect to each are disposed either concentrically or eccentrically along an axis transverse to the longitudinal axis of the cylinder. It will be observed that solid particulate is fed to the chamber through an inlet disposed along the top zone of the horizontally disposed cylinder, and the admixed or blended material is withdrawn from the chamber through an outlet along the bottom zone. In accordance with one embodiment of the invention, the inlet and outlet openings in the sidewall or cylinder wall are interposed between the end closures, along a transverse axis, and if arranged eccentrically, the openings preferably are so dimensioned as to overlap. In this manner, with the cylinder being inclined slightly from the horizontal as viewed in side elevation, the inlet opening is not at the highest point of the cylinder, and the outlet opening is not at the lowest or deepest point of the cylinder. In a preferred embodiment of the invention, with the cylinder viewed in front elevation, the inlet and outlet are substantially concentric with the central transverse axis of the cylinder and are thereby disposed at the at the highest and lowest point, respectively, of the cylinder. As explained more fully below, the relative positioning of the cylinder, the inlet and outlet, and the design and operation of the impeller (described below) achieve substantially uniform mixing within the desired and pragmatic time frame of a commercial operation.

A rotatable driven shaft is mounted in the cylindrical chamber along the central longitudinal axis. One end of the shaft is operably coupled with the output means or drive shaft of a motor arranged adjacent the cylinder. The opposed end of the rotatable driven shaft is supportably mounted in the opposite or second closure means to permit free rotation of the driven shaft. In a preferred embodiment of the invention this second closure means can be disengaged from or is removable from the cylinder to allow for access to the chamber.

A plurality of impellers are staggered axially along the rotatable driven shaft and depend radially therefrom. The number of impellers supported by the shaft and extending therefrom may vary depending on such factors as size of the cylinder chamber, rotor speed, and type, grade, or composition of solid particulate, e.g. plastic particles, and additives to be admixed. Each impeller terminates outwardly from the shaft at equidistance from the shaft with a planar end portion disposed at an oblique angle relative to the radial plane and in the direction of rotation. The planar end portions of the impellers overlap in a circumferential direction. Preferably, each impeller comprises a strut, arm, bracket, or the like, with the proximal end depending from the shaft and the distal end supporting the planar end portion which is large relative to the strut, thereby providing an open area or network as viewed longitudinally within the chamber to facilitate mixing. The outwardly disposed or leading edge of each planar surface is adjacent the inner surface of the chamber in close, spaced relationship thereto. A portion of this outward edge of each planar surface is tapered relative to the radial axis, so as to converge in the direction of the chamber wall thereby defining a planar wall having a substantially trapezoidal configuration, although the periphery and/or angles may be arcuate. In accordance with one embodiment of the invention, each impeller comprises a bracket, preferably having a substantially U-shaped configuration, with radially depending arms in longitudinally spaced and substantially parallel relation, and terminate at an oblique angle as described above, with a portion of the area at the terminal or outward part of the bracket being enclosed to define the planar surface.

In a typical blending operation, one or more additives is blended with the solid particulate, e.g. plastic pellets, which may include, for example, antioxidants, pigments, coloring agents, flame retardants, plasticizers, inert fillers, and the like, which may be either liquid or solid. In order to accomplish this, one or more openings or ports is provided in the cylinder wall in the top portion thereof (above the central horizontal axis or plane of the cylinder) adjacent the inlet for the plastic particulate. The openings are provided with a suitable nozzle and valve means for connecting the feed means to the mixer and for regulating the input or stopping the input.

The mixer of the present invention is therefore useful in a continuous process for admixing solid particulate, e.g. plastic pellets, particles, beads, etc., by admitting solid particulate to a substantially horizontally disposed cylinder through an opening in the upper portion of the sidewall of the cylinder, which is inclined not more than about 20 degrees with respect to the horizontal plane. Where desired, one or more additives, either as liquid or solid, is added to the mixing chamber. The blended material is withdrawn from the cylinder through an outlet disposed in the lower portion of the side wall and substantially opposite to that of the inlet. The particulate and additives, if used, are admixed in the chamber with impellers rotated through a radial plane relative to the longitudinal axis of the cylinder and transverse to the inlet and outlet. The mixer, including the unique design of the impellers, conveys the admixture inwardly from the outside, thereby achieving a substantially uniform admixture.

DETAILED DESCRIPTION OF THE INVENTION

Figure 1:
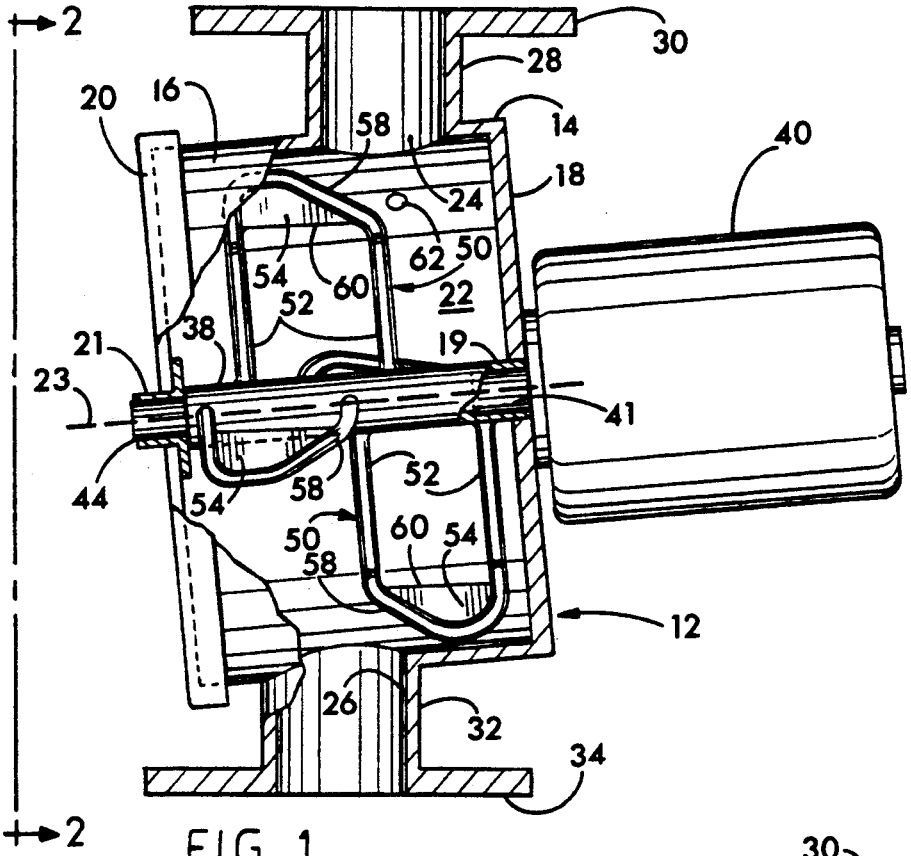
FIG. 1 is a side elevational view partly in cross section of the mixer of the present invention.
Figure 2:
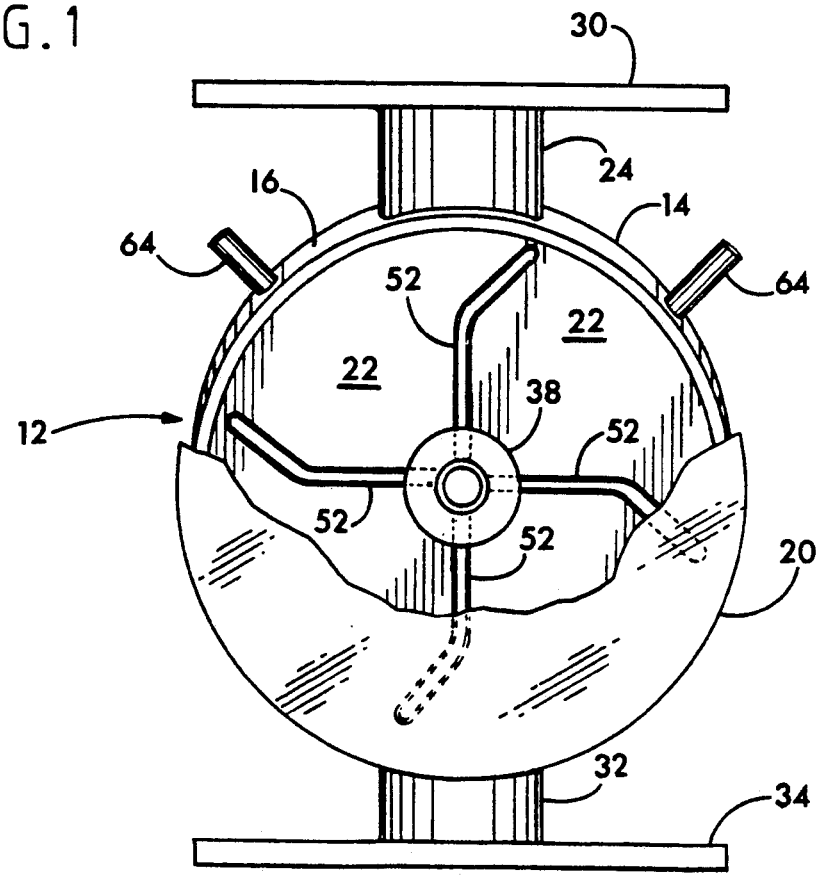
FIG. 2 is an end elevational view of the mixer of FIG. 1 on line 2—2 of FIG. 1.

Referring to the drawings wherein like reference numerals refer to similar parts throughout the various views, there is shown a mixer or blender, indicated generally by the numeral 12, especially adaptable for admixing solid particulate, which further may be admixed with one or more additives, described hereinbelow in greater detail. The solid particulate may comprise virgin or recycled plastic, or a mixture of both, as pellets, beads, particles, flakes, etc., and typically include such plastics as polyethylene, polypropylene, polyvinyl chloride, polystyrene, copolymers of styrene and acrylonitrile, and the like. By reason of our invention, even though the admixture may comprise virgin and recycled plastic, or may include solid or liquid additives, the admixture passed or pumped to the fabricator (e.g. extruder) is substantially uniform, and the resulting end product is essentially free or devoid of streaks, mottling, striations, or clouding. The mixer is especially useful for a continuous process, and typically a hopper of conventional design and operation (not shown), or other appropriate feed mechanism, is provided at the inlet to the mixer, and the outlet leads to a fabricating operation such as an extruder or molding machine not shown.

The mixer comprises a cylinder, indicated generally by the numeral 14, having a cylindrical sidewall 16 and opposed end walls 18 and 20 thereby defining a mixing chamber 22. The cylinder is positioned substantially horizontally, preferably inclined with respect to the central horizontal plane represented by the dash-dot line 23 from about 5 degrees to not more than about 20 degrees, and more preferably from about 10 to 15 degrees.

At the highest and lowest point of the cylinder 14 when viewed in profile (front elevation) are inlet 24 and outlet 26, respectively. Thus, the inlet and outlet are positioned concentrically or eccentrically along axes transverse to the longitudinal axis of the cylinder, and interposed between the end plates 18 and 20. Where desired, the inlet and outlet are positioned about midway between the end closures, and the inlet is disposed along a transverse axis of the cylinder and the outlet being offset from the inlet in the direction of the incline to the cylinder by a distance less than about the diameter of the inlet. We have found that when the inlet and outlet are offset, material build-up is prevented at these ports. Typically the inlet 24 is provided with an extension or neck 28, and base plate 30 is seated on the extension for supporting a conventional type hopper having an opening in alignment with the inlet. Similarly, outlet 26 has an extension or neck 32 for supporting base plate 34 which is connected to an inlet of a fabricating machine, e. g. extruder, whereby the blended particulate exiting the mixer is fed directly to the fabricating machine.

Cylinder 12 has opposed end walls 18 and 20, as stated above, and although shown as being substantially planar, it should understood that if desired one or both end walls may have a convex profile. Rear end wall 18 is formed integrally with the cylinder. It is preferable, however, that the forward end wall 20 can be disengaged from the cylinder in order to provide for easy access to the cylinder and to allow for cleaning or for changing impellers. Thus, end wall 20 is attached to the cylinder and seats on the marginal edge thereof, and is attached or engaged to the cylinder by clamps 36. Also, it may be desirable to view the chamber during operation, and for that reason end wall 20 may be formed of a rigid, transparent material such as Lexan. Further, end walls 18 and 20 are provided with central openings 19 and 21, respectively, for the reasons set forth hereinbelow.

Rotatable driven shaft 38 is mounted along the central longitudinal axis of the cylinder, and the opposed ends of the shaft 38 extend to openings 19 and 21 of end plates 18 and 20, respectively. At one end, motor 40, having an appropriate output shaft 41, is coupled to and coaxial with the impeller shaft 38. In this manner, shaft 38 is rotated by motor 40 disposed adjacent the cylinder at end wall 18. The opposed end of the shaft 38 has lateral shoulder 42 and reduced section 44 (see FIG. 3). Flanged bushing 46, having a central longitudinal opening 48 for accommodating reduced section 44, protrudes through opening 21 of end plate 20. Thus, on mounting the shaft 38, one end (the motor mount end) extends through opening 19 and is operably coupled with the output of motor 40, and the reduced section 44 of the opposed end is inserted into opening 48 of bushing 46 so that shoulder 42 abuts or seats against one side of surface of the flanged portion of bushing 46 and the opposite surface of this flange seats flush with the inwardly disposed surface of plate 20. Thus, shaft 38 driven by motor 40 and supported at the opposite end by flanged bushing 46 arranged concentrically with opening 21 is free to rotate, yet the mixing chamber remains essentially sealed.

Figure 5:
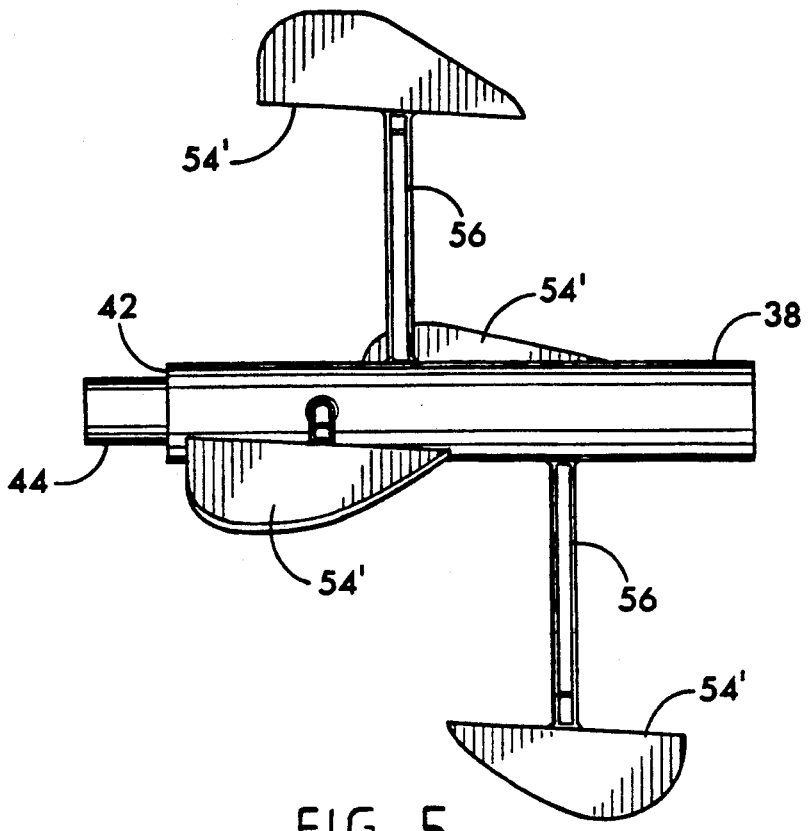
FIG. 5 is a side elevational view of an alternative embodiment of the impeller used in the mixer.
Figure 5A:
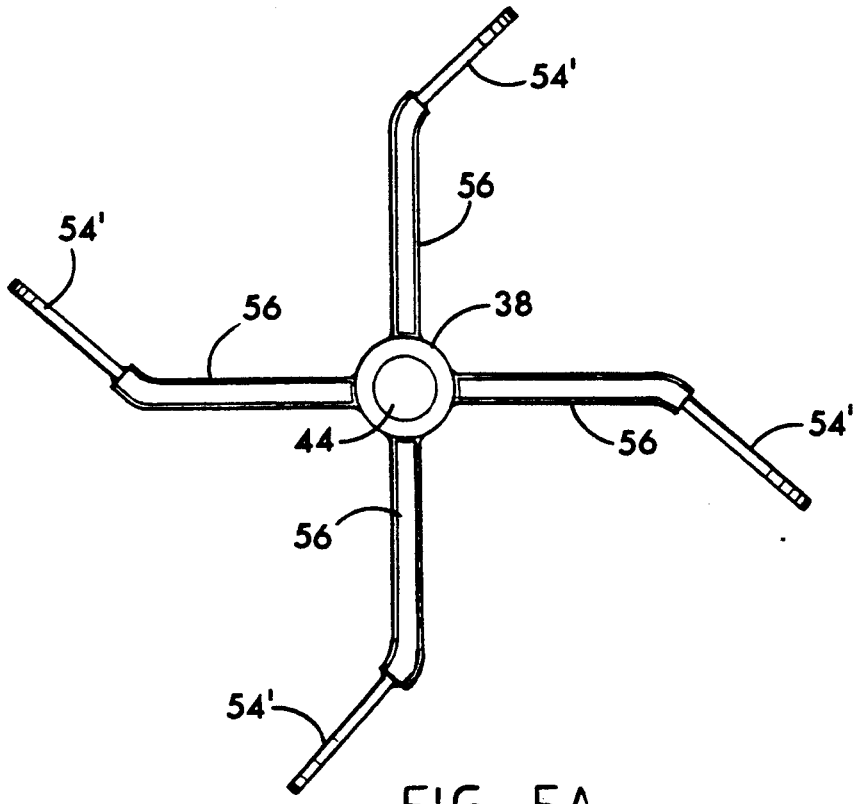
FIG. 5A is a front elevational view of the impeller of FIG. 5.

A plurality of impellers 50 having a substantially U-shaped configuration are staggered axially along driven shaft 38 and depend radially therefrom. Each impeller as measured from the shaft to the outward end thereof are substantially equal in length, that is each impeller is equidistance from the shaft. In accordance with one embodiment of the invention, each impeller, as shown best in FIGS. 1 and 3, comprises a bracket having a pair of radially depending arms or struts 52 supported at the proximal end by the shaft in longitudinally spaced and substantially parallel relation. The outwardly disposed portion, or distal portion, of the bracket is angled obliquely relative to the radial plane extending longitudinally of the shaft, and at an angle less than about 90 degrees, and preferably from about 30 to 60 degrees. A portion of the area defined by the base of the "U" of bracket 52 at the outwardly disposed angled end is enclosed to provide an enlarged planar surface, blade or paddle 54. It will be observed that by reason of this structure, the impeller has an open area or network, mesh, reticulation, or the like, which facilitates tumbling, lifting, and admixing. It should be understood, however, that the planar surface 54 can be supported by one strut or arm or by more than two such struts or arms, depending on such factors as the size of the mixing cylinder, the type and quantities of materials to be admixed, and the rotatable speed of the shaft. As shown in FIGS. 5 and 5A, the planar surface or blade 54, is supported by a single strut 56 depending from the rotatable driven shaft 38, with the enlarged planar surface angled obliquely with respect to the radial axis.

Figure 3:
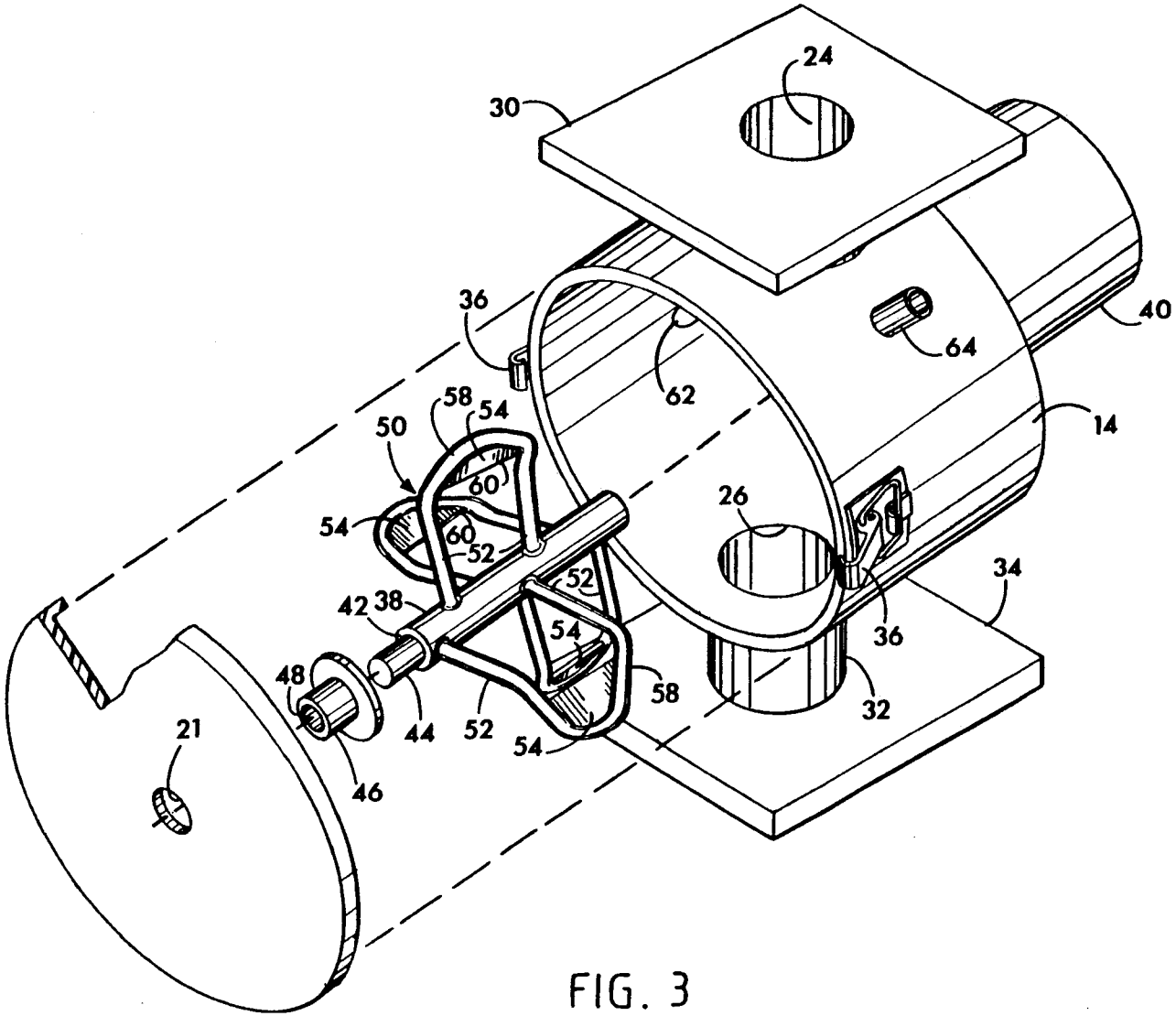
FIG. 3 is an exploded perspective view of the mixer of FIG. 1.
Figure 4:
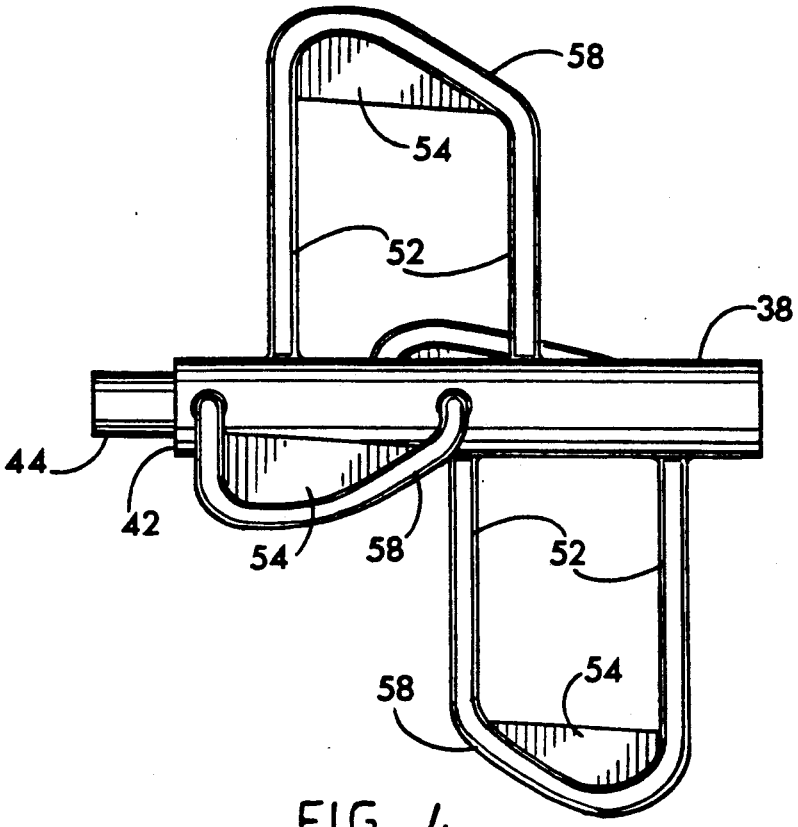
FIG. 4 is a side elevational view of the impeller showing in more detail the impeller used in the mixer of the present invention.
Figure 4A:
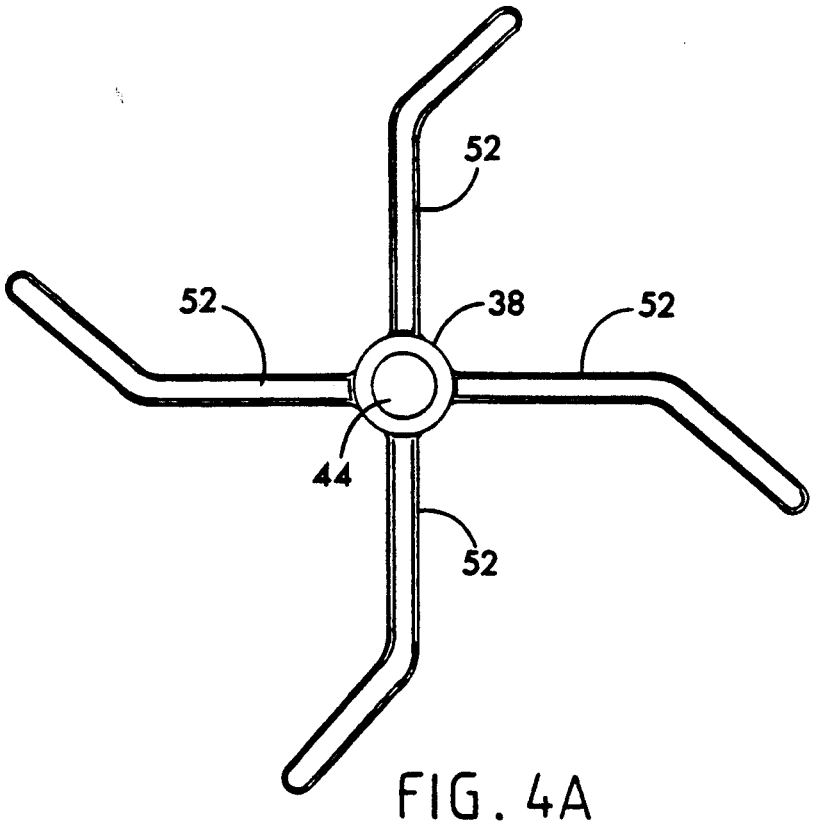
FIG. 4A is a front elevational view of the impeller of FIG. 4.

As best seen in FIGS. 1 and 3, for each impeller 50, a portion of the obliquely angled edge or side, relative to the radial axis, is tapered at 58, that is, the edge from about the angle outwardly converges in the direction of the chamber wall. The opposite edge of the impeller is essentially straight relative to the radial axis and viewed longitudinally, but this edge is angled as explained above. Thus, rather than the planar surface being essentially rectangular, the planar surface has essentially an irregular quadrilateral configuration, but it should be understood that one or more sides or angled corners can be slightly arcuate. In a preferred embodiment of the invention, the planar surface has a substantially trapezoidal configuration, although the sides and/or angles may be arcuate, and the taper for the sides may be in the same direction or in different directions. Still further, it is preferable to provide a straight edge for the impellers near the opposed ends of driven shaft 38 so as to be disposed substantially adjacent to the end walls 18 and 20 of the chamber and in close, spaced relationship to facilitate scraping of material from the end walls and to prevent build-up on the end walls. The innermost edge or base side 60 of the planar surface about coincides with the oblique angle defined by the bend in the struts, but where desired this edge 60 may be offset outwardly from this defined angle.

The impellers 50 are equally spaced about the circumference of the driven shaft 38, and planar surfaces 54 in the aggregate overlap in a circumferential direction. We have found that it is preferable for a commercial size mixer to provide four impellers for the mixer, each disposed at an angle substantially normal to two adjacent impellers.

The plastic particulate is typically admixed with one or more additives prior to being fed to the fabricating machine, e.g. extruder. In order to accomplish this, the mixer is provided with one or more openings or orifices 62 disposed above the central horizontal plane and adjacent or in the vicinity of the inlet 24. A short nozzle 64 extends from the opening for connecting the feed line for the additive to the chamber 22, and the nozzle typically is provided with a valve means or stopcock to control or regulate the flow of feed to the chamber or to stop the feed when not needed. The additives incorporated or admixed with the plastic particulate may either solid or liquid, and the number of orifices may vary depending upon the need and end product sought, and also for some operations two or more additives may be added to the mixer through the same orifice.

In using the mixer of the present invention, the admixture comprising plastic particulate (e.g. virgin plastic pellets or beads, recycled plastic pellets or beads, and solid or liquid additives, is conveyed inwardly from the outside and circumferentially; that is, to the side and back in the direction of the center of the cylinder. As the impeller rotates, the planar surface portion or paddle moves the material circumferentially while the oblique angle effects movement to the side, and because of the network design of the impeller, the material falls to the side and inwardly. Rotational speed of the impellers and size of the chamber are predetermined so that material entering through the inlet at the top does not simply fall through to the outlet at the bottom, but the disposition of the elements of the mixer and the design and structure of the impellers achieve a substantially uniform admixture within the desired time frame for an operation. When virgin plastic particulate is admixed with recycled plastic, or when additives are admixed with the plastic, the mixer of the present invention effectively admixes the materials so that an end product from the fabricating machine exhibits substantially no streaks, striations, clouding, or mottling. Thus, an end product free of such defects is achieved because there is sufficient admixing of the materials and the additives substantially wet, contaminate or engulf the plastic particulate.

The foregoing detailed description has been given for clearness of understanding only, and no unnecessary limitations should be understood therefrom, as modifications will be obvious to those skilled in the art.

What is claimed is:

1. A mixer especially adaptable for admixing solid particulate, comprising:

(a) a substantially horizontally disposed cylinder slightly inclined with respect to the horizontal plane and having opposed closure means defining a chamber and an inlet and outlet positioned above and below the central longitudinal axis of said cylinder, respectively;

(b) a rotatable driven shaft longitudinally mounted along the central longitudinal axis of said cylinder;

(c) a plurality of impellers staggered axially along said shaft and depending radially therefrom; and (d) each of said impellers terminating outwardly from said shaft with a substantially planar surface obliquely angled relative to the radial plane and in the direction of rotation and having an edge tapered inwardly relative to the radial axis, the outwardly disposed edge of each of said impellers disposed adjacent the inner wall of said chamber in close, spaced relationship thereto.

2. A mixer according to claim 1 wherein said cylinder is inclined with respect to the horizontal from about 5 to about 20 degrees, and said inlet and said outlet being substantially oppositely disposed along axes substantially transverse to said central longitudinal axis.

3. A mixer according to claim 2 wherein said inlet and said outlet are interposed between said closure means of said cylinder.

4. A mixer according to claim 2 wherein said inlet is disposed along the central transverse axis of said cylinder, and said outlet is offset from said inlet in the direction of said incline by a distance less than about the diameter of said inlet.

5. A mixer according to any one of claims 1 through 4 wherein said planar surfaces overlap in a circumferential direction.

6. A mixer according to claim 1 wherein each of said impellers comprises a strut radially depending from said shaft and terminates outwardly from said shaft with an enlarged planar surface.

7. A mixer according to claim 1 wherein each of said impellers comprises a bracket having a substantially U-shaped configuration having arms depending radially from said shaft in longitudinally spaced and substantially parallel relation and a portion of the area defined by the base of the "U" terminating outwardly from said shaft being enclosed to define said planar surface.

8. A mixer according to claim 1 or claim 7 wherein said tapered radial edges for at least two of said impellers are tapered in the same direction.

9. A mixer according to claim 8 wherein said cylinder includes at least one opening disposed above said central longitudinal axis adaptable for admitting solid or liquid additives to said chamber for admixing with said solid particulate.

10. A mixer according to claim 9 wherein four impellers are disposed along said shaft at substantially right angles to each other.

11. A mixer according to claim 10 wherein each impeller nearest the closure means has a substantially straight radial edge with said oblique angle and disposed adjacent the closure means in close, spaced relationship thereto.

12. A mixer according to claim 10 wherein said planar surface has a substantially trapezoidal configuration and the innermost disposed edge of said planar surface about coincides with said oblique angle.

13. A mixer according to claim 10 and further includes means for rotating said shaft disposed at one closure means of said cylinder, the opposite closure means being substantially transparent and removable from said cylinder, and means for attaching said opposite closure means to said cylinder.

14. A mixer especially adaptable for admixing solid particulate, comprising:

(a) a substantially horizontally disposed cylinder inclined with respect to the horizontal plane from about 5 to about 20 degrees and having opposed closure means defining a chamber, and an inlet and outlet substantially oppositely disposed along axes substantially transverse to the central longitudinal axis of said cylinder and positioned above and below said central longitudinal axis, respectively;

(b) a rotatable driven shaft longitudinally mounted along the central longitudinal axis of said cylinder;

(c) a plurality of impellers staggered axially along said shaft and depending radially therefrom; and (d) each of said impellers terminating outwardly from said shaft with a substantially planar surface obliquely angled relative to the radial plane and in the direction of rotation and having an edge tapered inwardly relative to the radial axis, the outwardly disposed edge of each of said impellers disposed adjacent the inner wall of said chamber in close, spaced relationship thereto, and said planar surfaces overlap in a circumferential direction.

15. A mixer according to claim 14 wherein said inlet is disposed along the central transverse axis of said cylinder, and said outlet is offset from said inlet in the direction of said incline by a distance less than about the diameter of said inlet.

16. A mixer according to claim 14 or claim 15 wherein each impeller nearest the closure means has a substantially straight radial edge with said oblique angle and is disposed adjacent the closure means in close, spaced relationship thereto.

17. A mixer especially adaptable for admixing solid particulate, comprising:

(a) a substantially horizontally disposed cylinder inclined with respect to the horizontal plane from about 5 to about 20 degrees and having opposed closure means defining a chamber, and an inlet and outlet substantially oppositely disposed along axes substantially transverse to the central longitudinal axis of said cylinder and positioned above and below said central longitudinal axis, respectively;

(b) a rotatable driven shaft longitudinally mounted along the central longitudinal axis of said cylinder;

(c) a plurality of impellers staggered axially along said shaft comprising a bracket having a substantially U-shaped configuration having arms depending radially from said shaft in longitudinally spaced and substantially parallel relation; and (d) each of said impellers terminating outwardly from said shaft and a portion of the area defined by the base of the "U" being enclosed to define a substantially planar surface obliquely angled relative to the radial plane and in the direction of rotation, each of said planar surface having a substantially trapezoidal configuration and having a radial edge tapered inwardly, the outwardly disposed edge of each of said impellers disposed adjacent the inner wall of said chamber in close, spaced relationship thereto, and said planar surfaces overlap in a circumferential direction.

18. A mixer according to claim 17 wherein said inlet is disposed along the central transverse axis of said cylinder, and said outlet is offset from said inlet in the direction of said incline by a distance less than about the diameter of said inlet.

19. A mixer according to claim 17 or claim 18 wherein each impeller nearest the closure means has a substantially straight radial edge with said oblique angle and is disposed adjacent the closure means in close, spaced relationship thereto.

20. A continuous process for admixing solid particulate of different composition, type or grade in a substantially horizontal cylinder inclined from the horizontal plane from about 5 to 20 degrees and having a plurality of rotatable impellers axially disposed, each impeller comprising strut means supporting an outwardly disposed, obliquely angled planar surface having a radial edge tapered inwardly, which comprises: continuously feeding said particulate to said cylinder through an inlet disposed above the central horizontal axis of said cylinder; admixing said particulate by conveying said particulate (a) inwardly from the outside and (b) substantially concomitantly circumferentially; and withdrawing the resulting admixture from an outlet disposed below said central horizontal axis.

21. A process according to claim 20 wherein said particulate comprises virgin plastic and recyled plastic.

22. A process according to claim 20 or 21 wherein said particulate comprises plastic and one or more additives.

23. A process according to claim 22 wherein said additive is selected from the group consiting of a coloring agent, pipment, antioxidant, flame retardant, plasticizer, and inert filler.

24. A process according to claim 23 wherein a liquid additive is admixed with said solid particulate.

* * * * *